US006494006B2

(12) United States Patent
Rainbolt

(10) Patent No.: US 6,494,006 B2
(45) Date of Patent: Dec. 17, 2002

(54) STRAW BALE WALL VENT BOX AND VENTING SYSTEM

(75) Inventor: John Rainbolt, Mill Valley, CA (US)

(73) Assignee: Sun-RG, East Palo Alto, CA (US)

( * ) Notice: Subject to any disclaimer, the term of this patent is extended or adjusted under 35 U.S.C. 154(b) by 75 days.

(21) Appl. No.: 09/835,050

(22) Filed: Apr. 13, 2001

(65) Prior Publication Data

US 2002/0148184 A1 Oct. 17, 2002

(51) Int. Cl.[7] ..... E04B 1/70
(52) U.S. Cl. ..... 52/302.1; 52/293.3
(58) Field of Search ..... 52/302.1, 302.2, 52/302.3, 302.4, 218, 97, 561, 293.3, 295, 292; 248/188.1, 346.03, 346.01; 206/386; 108/57.32, 57.17; 405/36

(56) References Cited

U.S. PATENT DOCUMENTS 3,668,829 A * 6/1972 Nelson ..... 52/169
5,765,323 A * 6/1998 Bevilacqua ..... 52/169.5
6,052,959 A * 4/2000 LaBrosse ..... 52/302.6
6,120,723 A * 9/2000 Butler ..... 264/333

OTHER PUBLICATIONS

Catherine Wanek, "Construct A Straw Bale Greenhouse", Nov./Dec. 2001, p. 4, paragraph 6.*

* cited by examiner

*Primary Examiner*—Carl D. Friedman
*Assistant Examiner*—Naoko Slack
(74) *Attorney, Agent, or Firm*—Perkins Coie LLP

(57) ABSTRACT

A straw bale wall vent box is provided in a wall joinery system comprising a lower member, a substantially planar top member, and a plurality of rebar disposed through the top member and a bottom side of the lower member. The lower member can further include insulation, a drainage floor sloping downwardly from an exterior side, and a trim piece extending from the bottom side towards the plaster screed. In some embodiments the trim piece joins the plaster screed. In those embodiments in which the trim piece joins the plaster screed, both sides of the lower member can each include at least one aperture. Additional embodiments are directed to a straw bale wall vent system comprising a plurality of wall vent boxes placed side by side so that the first and second sides of adjacent vent boxes are substantially in contact.

28 Claims, 9 Drawing Sheets

STRAW BALE WALL VENT BOX AND VENTING SYSTEM

BACKGROUND OF THE INVENTION

This invention relates generally to the field of straw bale construction and more specifically to a vent that is incorporated into the wall joinery system between the bottom of a straw bale wall and the top of its' foundation to allow condensation from within the wall to be removed.

Straw bale construction is a technique for building structures that greatly reduces and in some instances can even eliminate the use of lumber by forming walls out of stacked straw bales. The resurgence of straw bale construction has introduced current knowledge about modern materials and construction analysis to create structures that are especially durable and energy efficient when compared to both traditional lumber and non-lumber built structures. For example, modem straw bale construction features steel rebar that is driven through the straw bales that form the walls in order to provide strength, rather than more traditional materials such as bamboo or lumber. In addition, cables can be wrapped from the foundation to the roof-plate to form an exoskeleton. Modern straw bale construction also takes advantage of computer simulation and other techniques presently adapted to building construction to optimize designs for improved energy efficiency, for example.

The greatest strengths of straw bale construction are the fact that it is using a waste product as a building material and that wall structures having insulation values from r50–r60 are possible. These two factors make this construction medium an extremely promising component for addressing the global energy situation. However, there are several places where this technique needs refinements.

One involves the most vulnerable point of straw bale construction, namely moisture that tends. to collect in the lower outside corner of the wall. Therefore, the need exists for a vent system incorporated into the wall joinery system between the bales and the foundation in order to increase the longevity of straw bale wall systems. When kept dry, bales have been shown to last in excess of 100 years.

Straw bale construction combines well with other building technologies like greenhouses and cob for thermal mass. As a result, structures that combine the advantages of several natural building techniques are facilitated by straw bale—allowing designs of maximum diversity, efficiency, and comfort.

These four advantages make straw bale special with respect to the following environmental considerations: 1) Reduced lumber consumption, 2) Increased thermal efficiency, 3) Use of a waste product as a building material, and 4) Adaptability to other building technologies. Clearly, a system that would increase the longevity of straw bale wall systems would further advance these environmental factors.

As shown in FIG. 1, straw bale structures typically include a cement foundation 10 and a wall 12 disposed thereon. The wall 12 is built of a plurality of straw bales 14 held in place by a plurality of steel rebar 16. The rebar 16 between a first row 18 of straw bales 14 and the foundation 10 is set in the foundation 10 while the cement is still wet. Thereafter, the first row 18 of straw bales 14 is set in place such that each bale 14 is impaled onto rebar 16 protruding from the foundation 10. FIG. 1 includes a partial cut-away section to show several rebar 16 set into the foundation 10 and protruding up into a straw bale 14. A new set of rebar 16 is then driven into the first row 18 of bales 14 such that approximately half of the length of each rebar 16 protrudes out of the bales 14. A next row of bales 14 is then impaled on the rebar 16 and the process is repeated. It will be apparent to one skilled in the art that this technique can be varied in many ways including the offset of the bales 14 from one row to the next as well as in terms of the number of rebar 16 used per bale 14, the particular arrangement of rebar 16, and how that arrangement is offset between adjacent rows of bales 14.

As shown in FIG. 2 a typical straw bale wall 12 includes both an interior siding 20 and an exterior siding 22. The interior siding 20 is commonly formed of plaster and is provided to prevent straw and straw dust from contaminating the interior of the structure, to provide a preferred surface for painting and anchoring fixtures, and to improve the insulation value of the wall 12. The exterior siding 22 is commonly formed of stucco and is provided to prevent the bales 14 from degrading due to sun, rain, and wind, to provide a preferred surface for painting and anchoring fixtures, and to improve the insulation value of the wall 12. An interfacial layer (not shown) is provided on both sides of the wall 12 to improve the adherence of sidings 20, 22. Interfacial layer 24 is commonly chicken wire.

Straw bale walls 12 have proven to be strong and durable, and have excellent insulating properties. However, it has also been found that warm, moist air from within the structure can penetrate the plaster of the interior siding 20. This can cause condensation 23 to form on an interior surface 24 of the exterior siding 22. The condensation 23 then tends to drip down the interior surface 24 and pool at the bottom along the foundation 10, as shown in FIG. 2, and can cause the straw to rot.

Accordingly, what is desired is a venting system that can be interposed between the wall 12 and the foundation 10 to collect moisture and to vent it back into the interior of the structure without significantly increasing building costs and without significantly diminishing the insulation value of the wall 12.

SUMMARY OF THE INVENTION

According to an embodiment of the present invention, a straw bale wall vent box comprises a lower member, a substantially planar top member, and a plurality of rebar disposed through the top member and the bottom side of the lower member. The lower member includes substantially parallel first and second sides, an exterior side, and an optional bottom side. The top member is substantially planar and includes a plurality of apertures, and can further include a stucco screed on an exterior end and a plaster screed on an interior end. The top member is disposed above and substantially parallel to the bottom side of the lower member, and is joined to a top edge of the exterior side of the lower member. The plurality of rebar is disposed through the top member and the bottom side of the lower member. This structure is advantageous as the apertures allow moisture from the straw bales to enter the vent box from which it can then vent into the air space above the foundation. The rebar serves to transfer the load from the top member to the foundation.

It will be appreciated that although the embodiments described herein and shown in the drawings all include stucco and plaster screeds, these are not critical elements to the invention and in some simple embodiments they are excluded. One of skill in the art will readily see how the invention can be constructed and used without screeds, or with only an exterior or interior screed.

The lower member can further include a drainage floor sloping downwardly from the exterior side, the rebar being disposed through the drainage floor. In those embodiments that include a drainage floor the bottom side is optional. The lower member can also include a trim piece substantially parallel to the exterior side and extending from the bottom side towards the plaster screed. The trim piece in some embodiments joins the plaster screed. In some embodiments the drainage floor joins the trim piece along its top edge, and in other embodiments along a line beneath and substantially parallel to the top edge. The drainage floor is advantageous to guide moisture towards the interior side of the vent box. In those embodiments in which the drainage floor joins the trim piece along its top edge, moisture can drain out of the vent box. In those embodiments in which the drainage floor joins the trim piece beneath the top edge, the moisture will tend to evaporate and vent out of the box through the opening between the top edge of the trim piece and the plaster screed.

In those embodiments in which the trim piece joins the plaster screed, the first and second sides of the lower member each can include at least one aperture. In those embodiments that include a drainage floor, the apertures in the first and second sides are disposed above the line along which the drainage floor joins the two sides. In other embodiments in which the trim piece joins the plaster screed, the first and second sides of the lower member are each bounded by the bottom side, the exterior side, and the drainage floor. In each of these embodiments the advantage of either apertures or first and second sides that do not extend beyond the drainage floor is to provide for air circulation between adjoining vent boxes when configured as a straw bale wall vent system as will be described in greater detail below.

Some embodiments include insulation within the bottom portion of the lower member. The insulation is advantageous to insulate against the cold of the foundation. In some of these embodiments a space within the lower member is defined by the bottom side, the drainage floor, the exterior side, and the first and second sides, and this space includes an insulation. However, in those embodiments that do not include a drainage floor the insulation can simply form a layer on the bottom side of the lower member.

Additional embodiments of the present invention are directed to a straw bale wall vent system comprising a plurality of wall vent boxes, as previously described, wherein the plurality of wall vent boxes are placed side by side so that the first and second sides of adjacent vent boxes are substantially in contact. In those embodiments in which each vent box includes a trim piece that extends upwardly to join the plaster screed, the plurality of adjoining vent boxes essentially forms a tube. Therefore, to provide air circulation necessary to remove excess moisture, the system further includes an air blower configured to force air into one of the vent boxes, and an outlet in one of the vent boxes through which the air may escape.

These and other advantages of the present invention will become apparent to those skilled in the art upon a reading of the following descriptions of the invention and a study of the several figures of the drawings.

BRIEF DESCRIPTION OF THE DRAWINGS

The present invention will be readily understood by the following detailed description in conjunction with the accompanying drawings, with like reference numerals designating like elements.

DETAILED DESCRIPTION OF THE PREFERRED EMBODIMENTS

Figure 1:
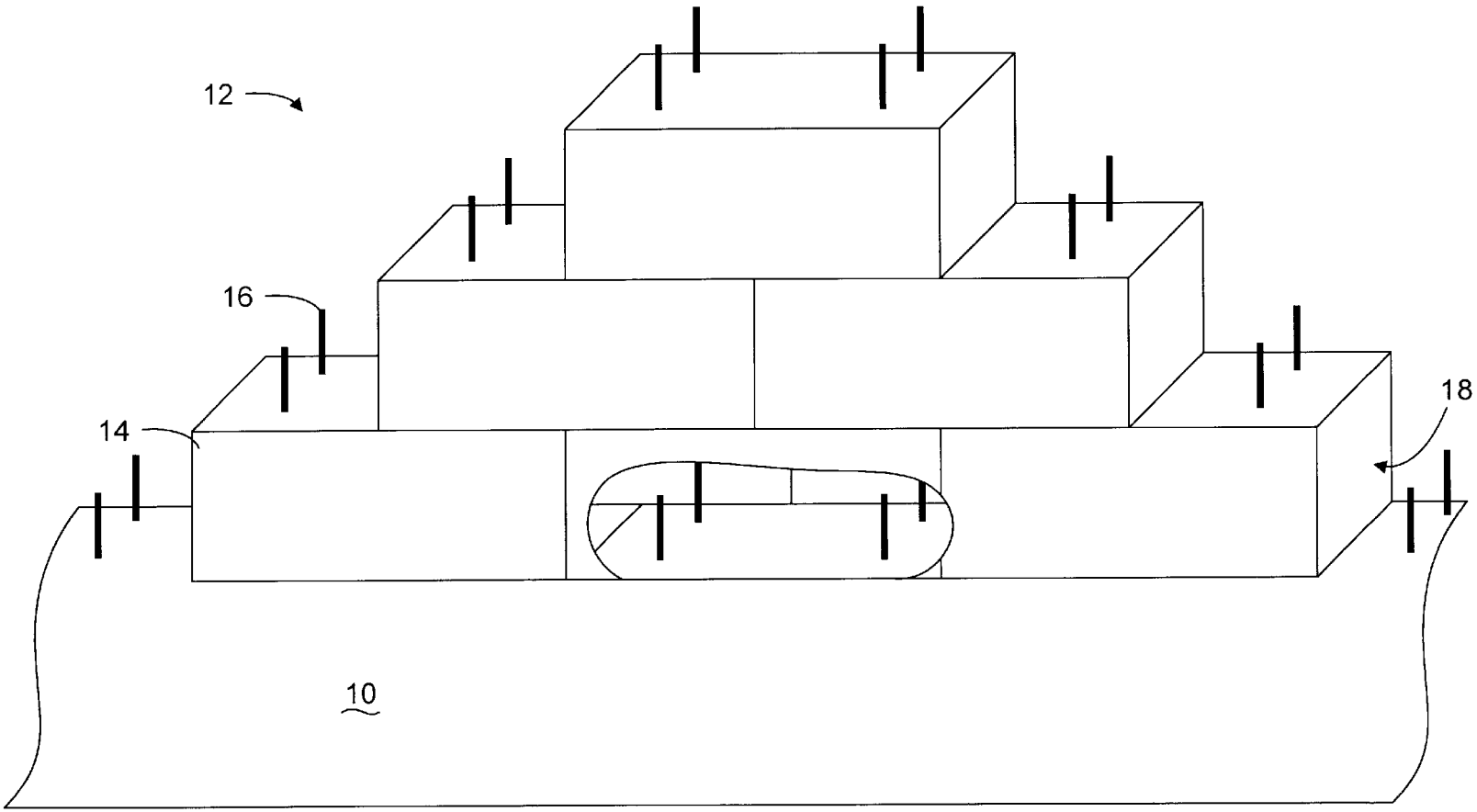
Figure 1 (Prior Art)
FIG. 1 is a perspective view of a straw bale wall constructed according to the prior art.
Figure 2:
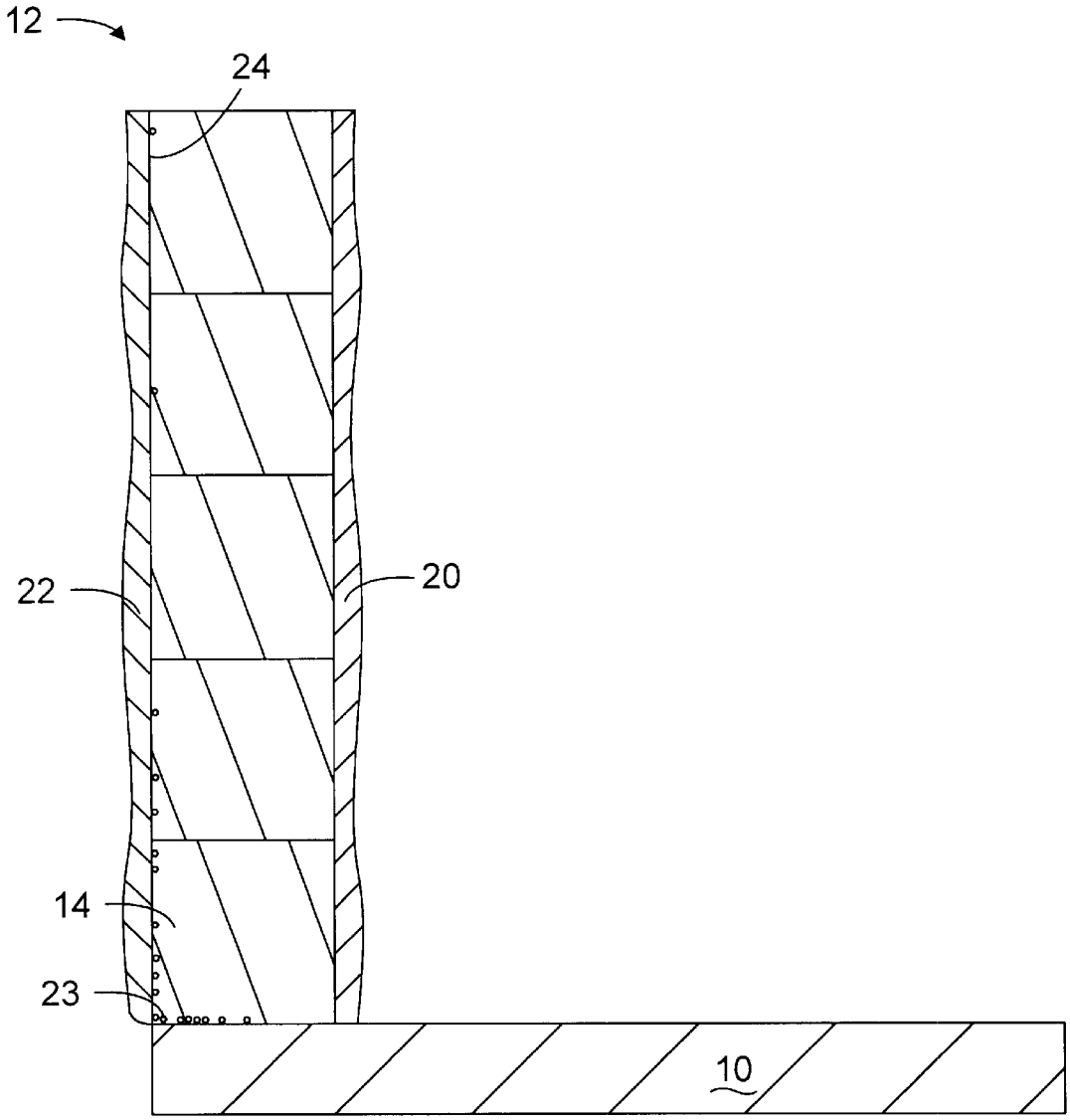
Figure 2 (Prior Art)
FIG. 2 is a cross-sectional view of a straw bale wall constructed according to the prior art.

FIGS. 1 and 2 were discussed with respect to the prior art.

Figure 3:
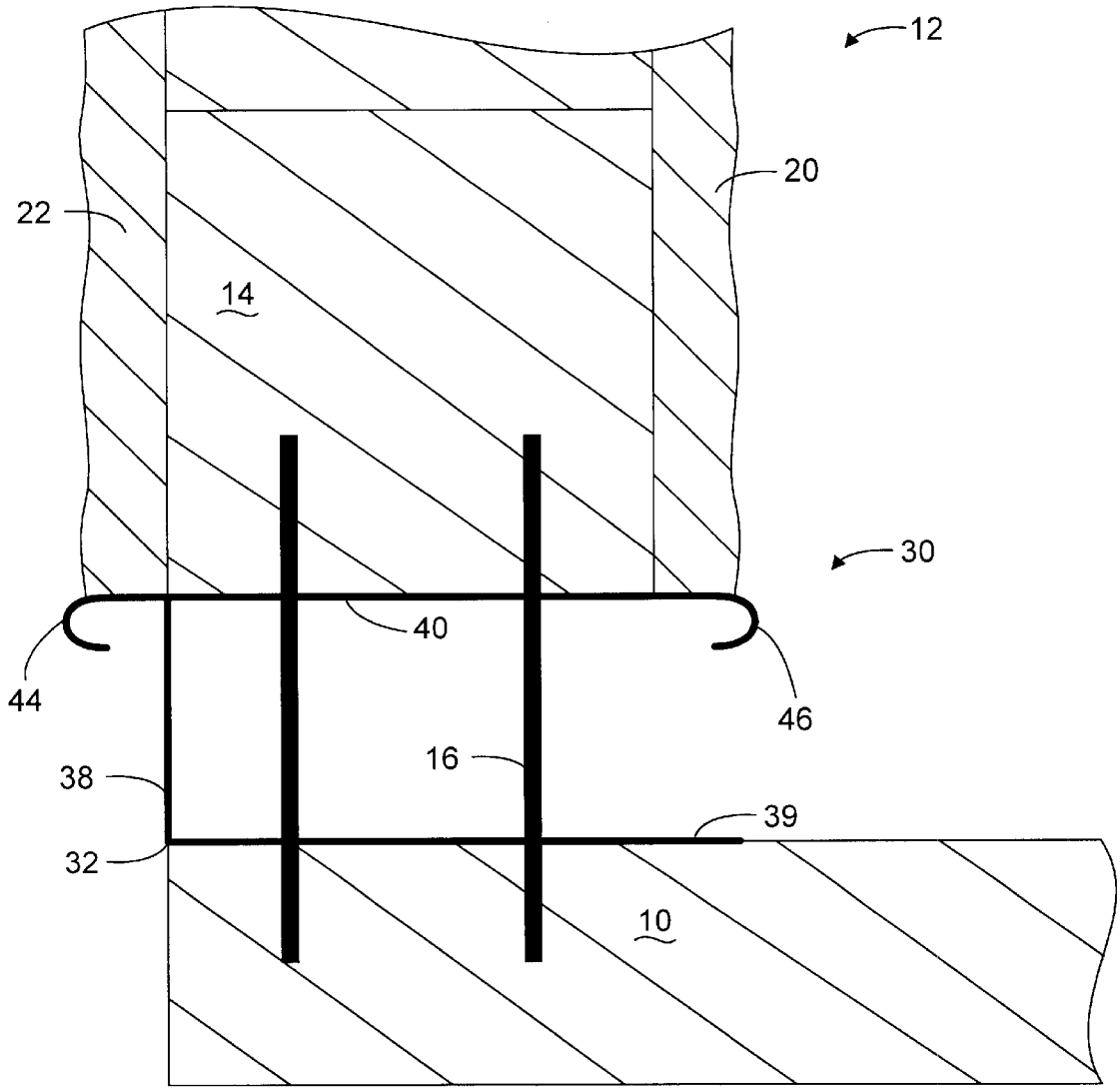
FIG. 3 is a cross-sectional view of an embodiment of a straw bale wall vent box of the present invention disposed between a straw bale wall and a foundation.
Figure 4:
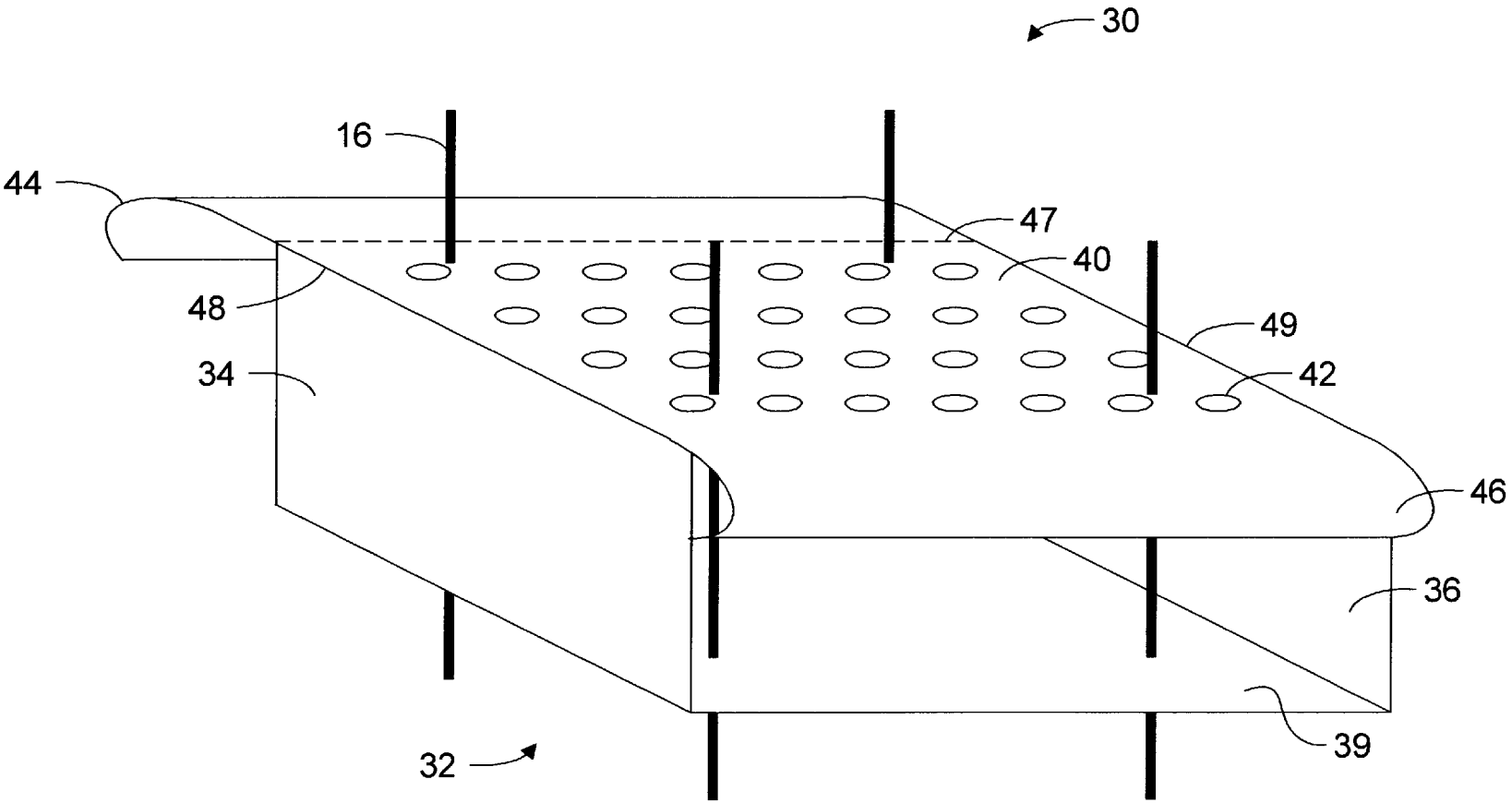
FIG. 4 is a perspective view of an embodiment of a straw bale wall vent box of the present invention.

FIG. 3 shows a cross-section of a straw bale wall vent box 30 of the present invention disposed between a foundation 10 and wall 12, and FIG. 4 shows a perspective view of the same vent box 30. Vent box 30 comprises a lower member 32 having substantially parallel first and second sides 34, 36, an exterior side 38, and a bottom side 39. Vent box 30 further includes a top member 40 including a plurality of apertures 42. The top member 40 is disposed above and substantially parallel to the bottom side 39 and includes a stucco screed 44 on an exterior end and a plaster screed 46 on an interior end. The top member 40 joins a top edge 47 of the exterior side 38 of the lower member 32 proximate to the exterior end of top member 40. In this particular embodiment top member 40 additionally joins top edges 48, 49 of sides 34, 36, as shown. It should be noted that as used herein, a plurality of apertures 42 is meant to be interpreted broadly to include any type of passageway for moisture. Accordingly, top member 40 can include, for example, a moisture permeable material and a plurality of apertures 42 would be the channels through the material that allow the moisture through.

Additionally, vent box 30 also includes a plurality of rebar 16 disposed through the bottom side 39 of the lower member 32 and through the top member 40. Each of the sides of the vent box 30 are constructed out of durable construction materials such as sheet aluminum. It will be appreciated by those skilled in the art that a vent box 30 of the present invention can be fabricated in numerous ways, depending on the choice of materials. Of particular importance, however, is that rebar 16 should be securely joined to top member 40 and bottom side 39, for example by welding or brazing, so that the loads on these surfaces is transferred to the rebar 16.

Figure 5:
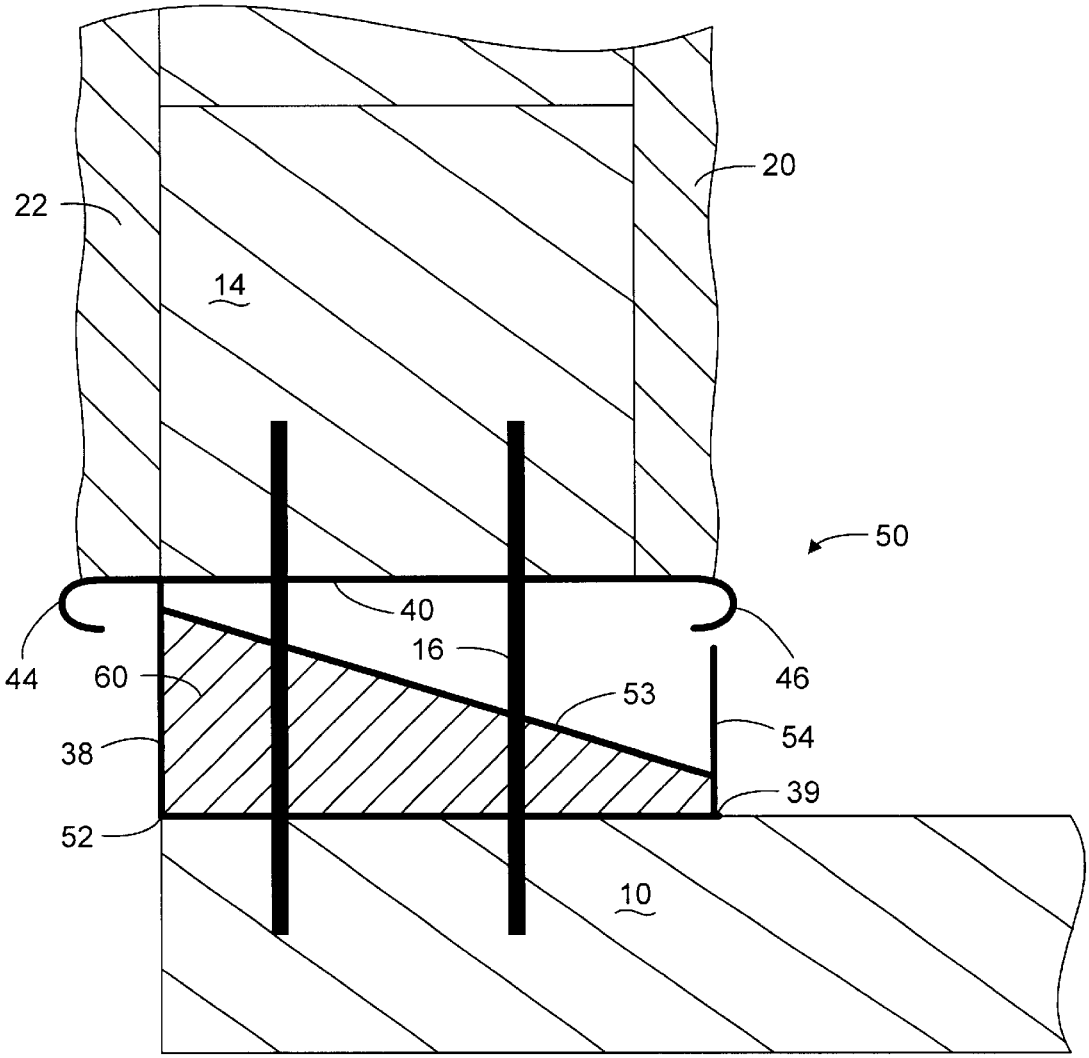
FIG. 5 is a cross-sectional view of another embodiment of a straw bale wall vent box of the present invention disposed between a straw bale wall and a foundation.
Figure 6:
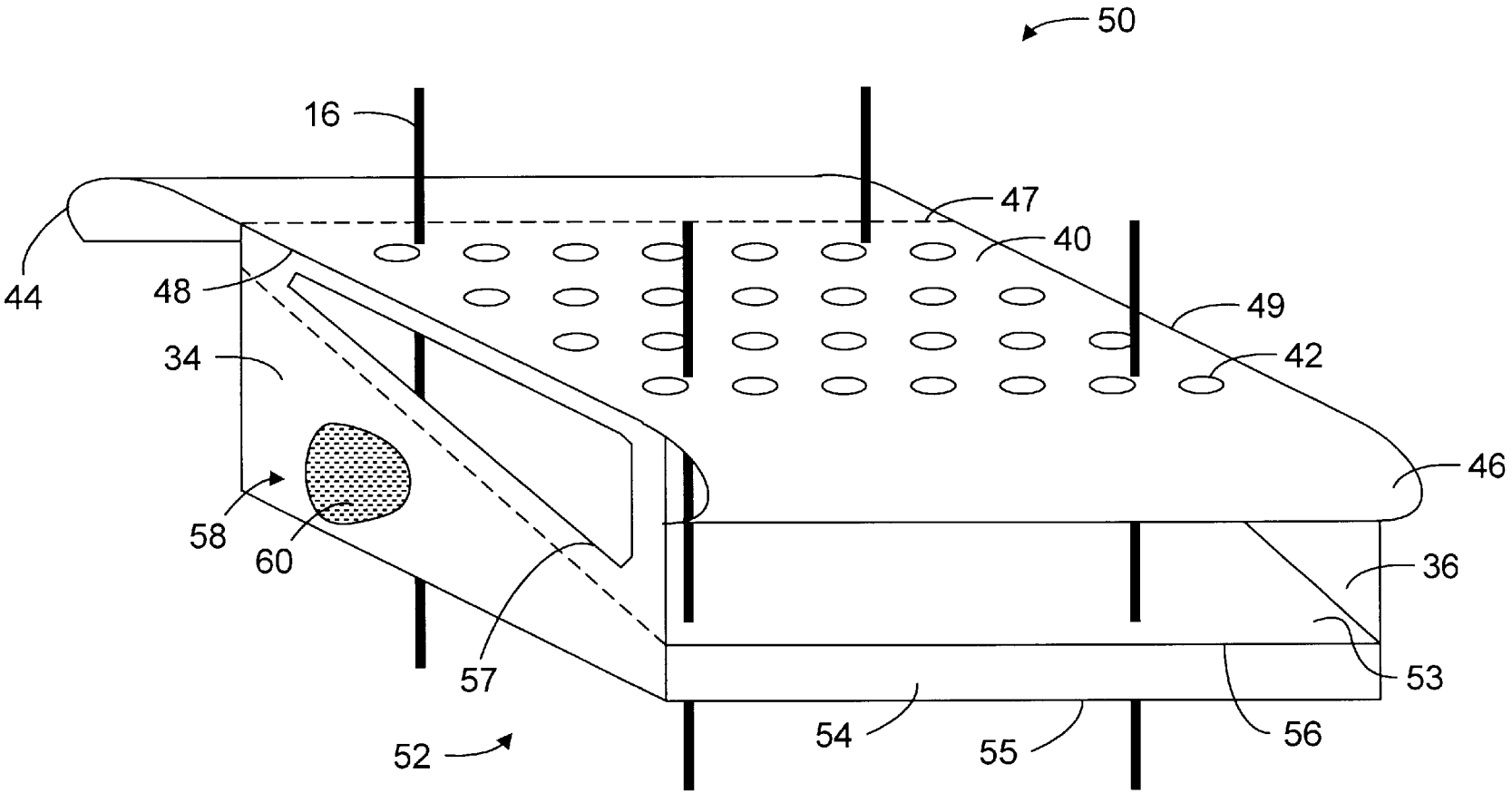
FIGS. 6 is a perspective view of another embodiment of a straw bale wall vent box of the present invention.
Figure 7:
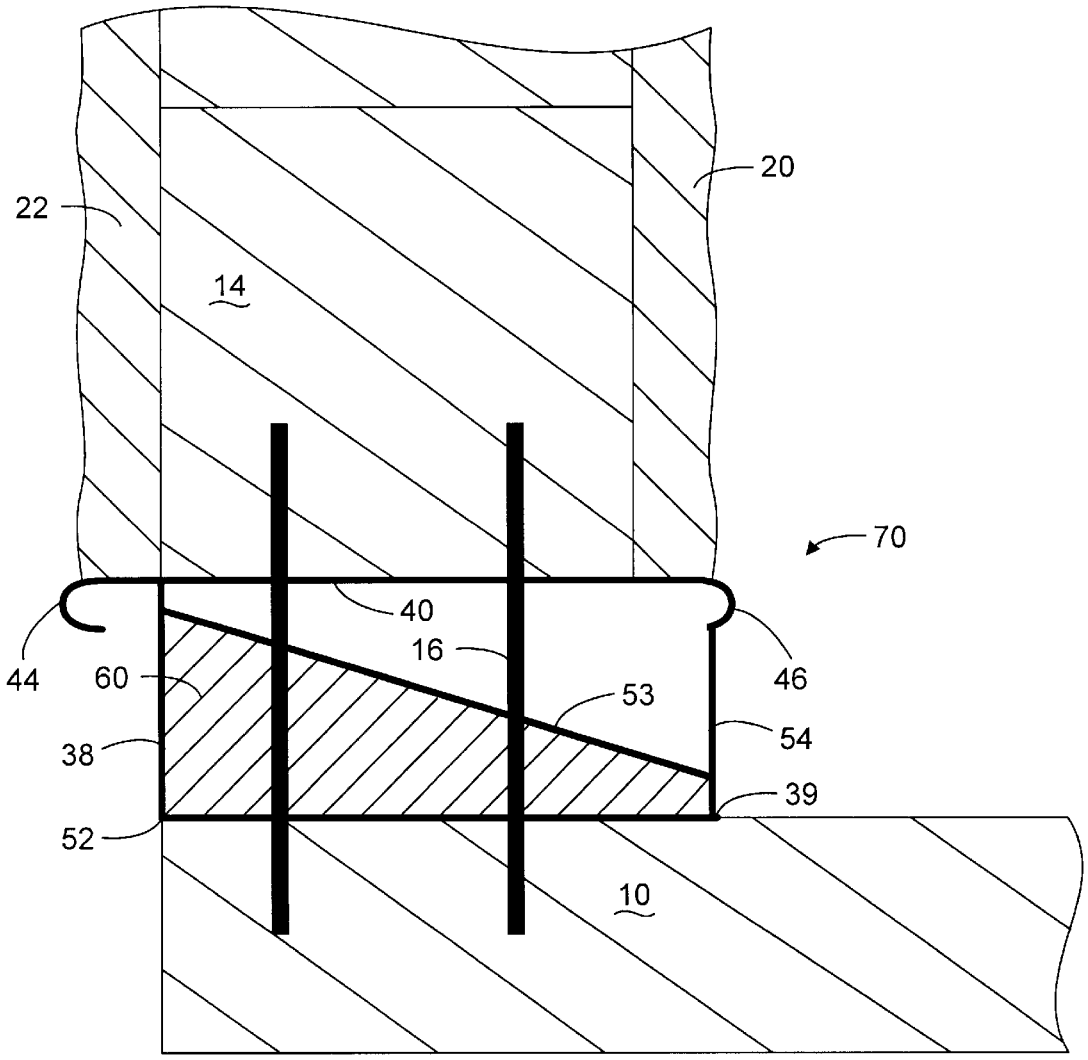
FIG. 7 is an cross-sectional view of yet another embodiment of a straw bale wall vent box of the present invention.

FIG. 5 shows in cross-section a another embodiment of a straw bale wall vent box 50 of the present invention disposed between a foundation 10 and wall 12, and FIG. 6 shows a perspective view of the same vent box 50. Vent box 50 comprises a lower member 52 having substantially parallel first and second sides 34, 36, an exterior side 38, a drainage floor 53, and an optional bottom side 39. Vent box 50 can also include a trim piece 54 that extends upwardly towards a plaster screed 46 from an interior edge 55 of the lower member 52. In some embodiments, as shown in FIG. 6, trim piece 54 joins drainage floor 53 along a lower edge 56 of drainage floor 53. In other embodiments the trim piece extends upwardly beyond lower edge 56 towards plaster screed 46 to form a narrow gap between the top of the trim piece 54 and the bottom of the lip of the plaster screen 46, as seen in FIG. 5. In some embodiments first and second sides 34, 36 can also include one or more apertures 57 disposed above the lines where the drainage floor 53 joins each of the sides 34, 36. In those embodiments where the trim piece 54 joins plaster screed 46, as shown in FIG. 7, one or more apertures 57 are necessary to allow ventilation between adjacent vent boxes 70, as will be described below with reference to a straw bale wall vent system.

Vent box 50 further includes a top member 40 including a plurality of apertures 42. The top member 40 is disposed above and substantially parallel to the bottom side 39 and includes a stucco screed 44 on an exterior end and a plaster screed 46 on an interior end. The top member 40 joins a top edge 47 of the exterior side 38 of the lower member 52 proximate to the exterior end of top member 40. In this particular embodiment top member 40 additionally joins top edges 48, 49 of sides 34, 36, as shown. Additionally, vent box 50 also includes a plurality of rebar 16 disposed through the drainage floor 53 and the bottom side 39 of the lower member 52 and through the top member 40. As above, each of the sides of the vent box 50 are constructed out of durable construction materials, and the rebar 16 should be securely joined to top member 40 and drainage floor 53, and bottom side 39 where present.

In some embodiments of vent box 50 a space 58 within lower member 52 defined by the drainage floor 53 and the three sides 34, 36, and 38 is filled with an insulation 60. In those embodiments that include a bottom side 39, side 39 also will define the space 58 within lower member 52, and in those embodiments that do not include bottom side 39 the insulation 60 preferably should not extend below where bottom side 39 would be. The insulation 60 can be either a solid material such as foamed polyurathane or sections of fiberglass, or can be a loose material such as packing peanuts. Inclusion of a bottom side 39 can be advantageous to hold the insulation 60 in place through assembly of the vent box 50 and through subsequent acts of storage, shipment, handling, and installation.

Figure 8:
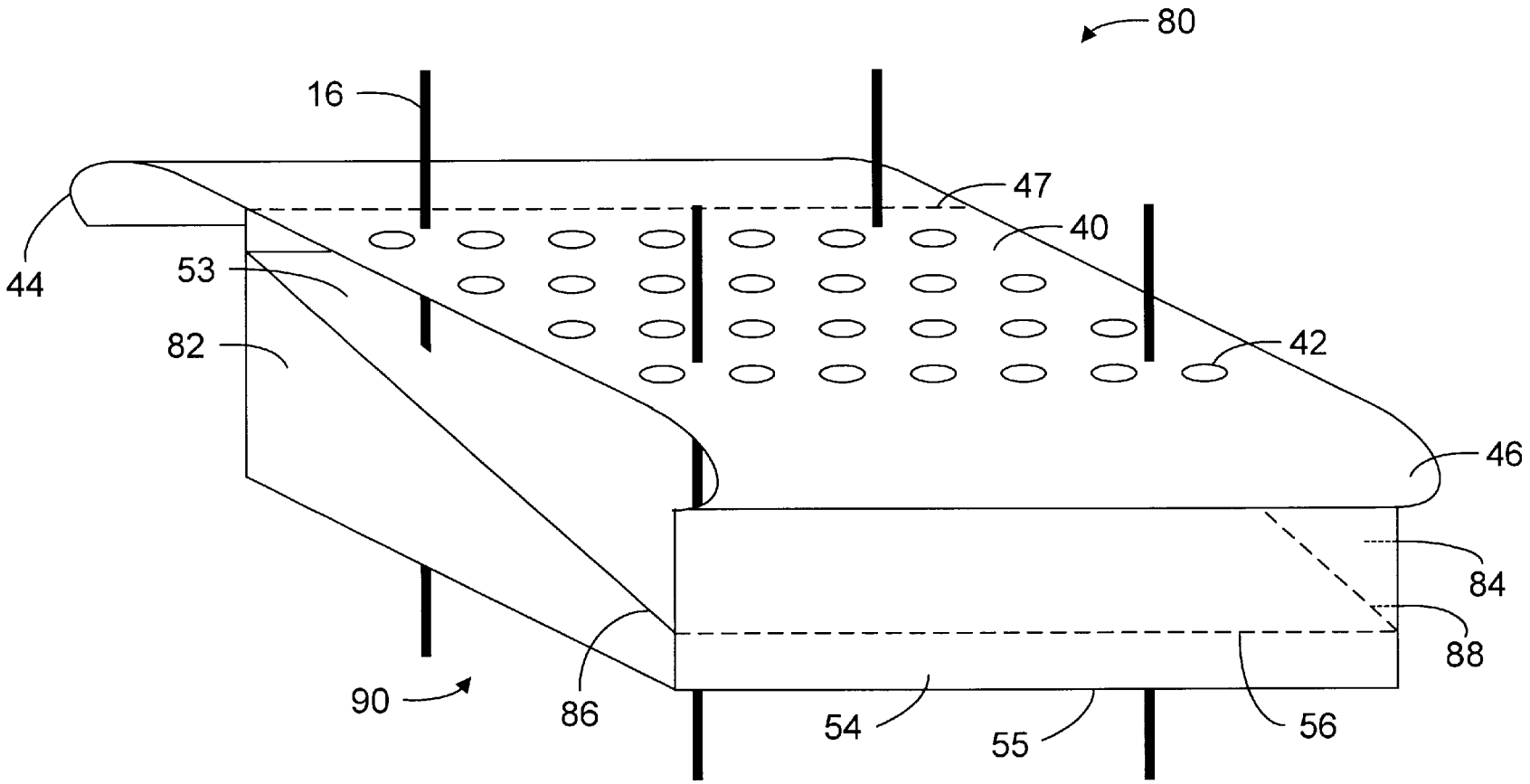
FIG. 8 is a perspective view of yet another embodiment of a straw bale wall vent box of the present invention.

FIG. 8 shows a perspective view of another embodiment of a straw bale wall vent box 80 of the present invention. Vent box 80 differs from the previously described embodiments only in that first and second sides 82, 84 do not join top member 40. Rather, each of the two sides 82, 84 have a top edge 86, 88 that joins the drainage floor 53. Thus, the top member 40 only contacts the bottom member 90 along top edge 47 of the exterior side 38. It will be apparent that this embodiment would also allow ventilation between adjacent vent boxes 80 as part of a straw bale wall vent system, much as vent box 70 shown in FIG. 7. The embodiment shown in FIG. 8 can also be modified such that edge 56 is coincident with edge 55, and so that drainage floor 53 joins exterior side 38 and top surface 40 along top edge 47.

Figure 9:
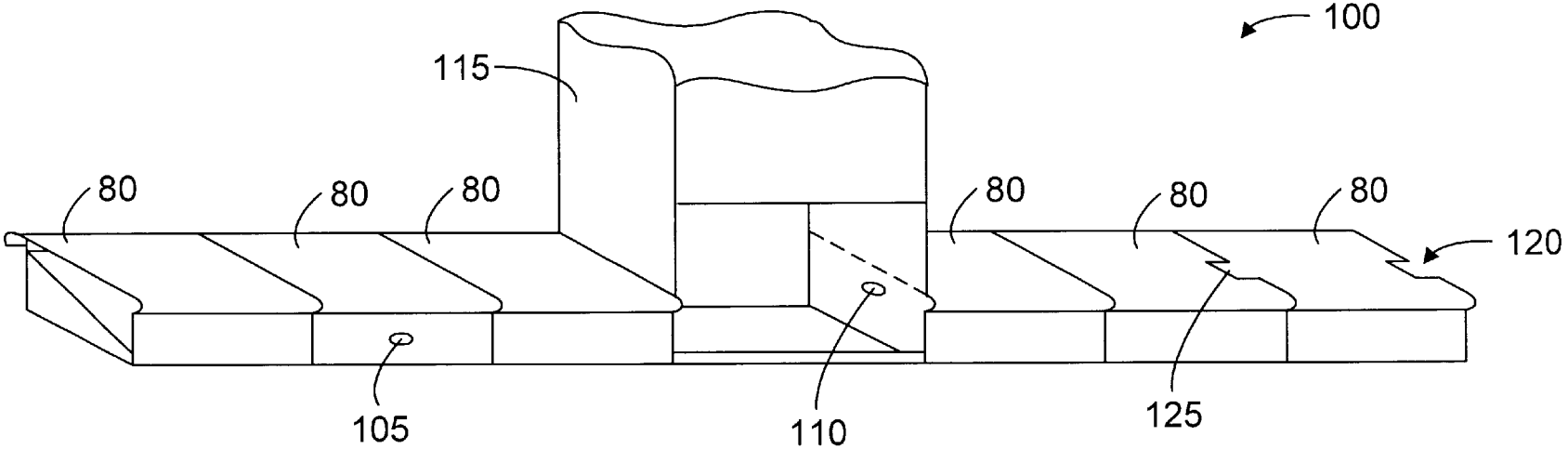
FIG. 9 is a perspective view of an embodiment of a straw bale wall vent box system of the present invention.

FIG. 9 shows a perspective view of an embodiment of a straw bale wall vent system 100 of the present invention. Multiple vent boxes 30, 50, 70, 80 can be assembled end to end as shown to create a wall vent system 100. Vent boxes 70, 80 are particularly desirable as they allow ventilation to occur between adjoining members. In this way a vent box system 100 can run continuously around an entire foundation and form a closed loop, with specially adapted pieces for comers and the like. In those embodiments of the system 100 that include vent boxes 70, 80, the system can further include a first inlet 105 and a second inlet 110. In some embodiments, such as the one shown in FIG. 9, air is drawn into the system 100 through first inlet 105 and exits through second inlet 110. The air can be drawn through the system by any vacuum source, for example, a vacuum pump. A particularly convenient vacuum source in the home, however, is a fireplace 115. As is well known, rising air in a chimney of a fireplace 115 draws air in behind it because it is creating a partial vacuum. Accordingly, in some embodiments second inlet 110 is configured to vent into a fireplace 115.

It should be noted that although FIG. 9 shows second inlet 110 configured in much the same location as an aperture 57 would be located, either inlet 105, 110 can be located on any of the walls of the vent box that is convenient. In other embodiments air is forced into the system 100 through first inlet 105 and exits through second inlet 110. The air can be forced into the system by any forced air source, for example, a source of compressed air, a fan, or a blower. It should also be noted that although the vent box system is herein described in terms of an assembly of a plurality of vent boxes, it will be appreciated by those of skill in the art that the same effect can be achieved by suitable modification of regular commercial air ducts. Such modification would include, for example, running rebar through the duct so that the duct can support the straw bale wall over the foundation.

FIG. 9 shows an additional feature that can be useful in the assembly of a wall vent system 100. Vent boxes 30, 50, 70, 80 can be configured to include a slot 120 and tab 125 that interlock when multiple vent boxes are placed together to form a vent system 100. It will be appreciated that in addition to placing a slot 120 and tab 125 on the top member 40 as shown, a slot 120 and tab 125 could also be placed on any of the components of the bottom member. It will further be appreciated that multiple slots 120 and tabs 125 can be employed per vent box.

Although the foregoing invention has been described in some detail for the purpose of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A straw bale wall vent box comprising:

a lower member including substantially parallel first and second sides, an exterior side, and a bottom side;

a substantially planar top member including a plurality of apertures and disposed above and substantially parallel to said bottom side, said top member joining a top edge of said exterior side of said lower member; and a plurality of rebar disposed through said top member and said bottom side of said lower member.

2. The straw bale wall vent box recited in claim 1 wherein said top member further includes a stucco screed on an exterior end and a plaster screed on an interior end.

3. The straw bale wall vent box recited in claim 2 wherein said lower member further includes a trim piece substantially parallel said exterior side and extending from said bottom side towards said plaster screed.

4. The straw bale vent box in claim 3 wherein said trim piece joins said plaster screed.

5. The straw bale vent box in claim 2 wherein said lower member further includes a drainage floor sloping downwardly from said exterior side, said rebar being disposed through said drainage floor.

6. The straw bale vent box in claim 5 wherein said lower member further includes a trim piece substantially parallel said exterior side and extending from said bottom side towards said plaster screed.

7. The straw bale vent box in claim 6 wherein said drainage floor joins said trim piece along a top edge thereof.

8. The straw bale vent box in claim 5 wherein said first and second sides of said lower member are each bounded by said bottom side, said exterior side, and said drainage floor.

9. The straw bale wall vent box recited in claim 1 wherein said lower member further includes a drainage floor sloping downwardly from said exterior side, said rebar being disposed through said drainage floor.

10. The straw bale wall vent box recited in claim 9 wherein a space defined by said bottom side, said drainage floor, said exterior side, and said first and second sides includes an insulation.

11. The straw bale vent box in claim 9 wherein said first and second sides of said lower member are each bounded by said bottom side, said exterior side, and said drainage floor.

12. The straw bale vent box in claim 1 wherein said first and second sides of said lower member each include at least one aperture.

13. A straw bale wall vent box comprising:

a lower member including substantially parallel first and second sides, an exterior side, and a drainage floor sloping downwardly from said exterior side;

a substantially planar top member including a plurality of apertures and disposed above and substantially parallel to said bottom side, said top member joining a top edge of said exterior side of said lower member; and a plurality of rebar disposed through said top member and said drainage floor.

14. The straw bale wall vent box recited in claim 13 wherein said top member further includes a stucco screed on an exterior end and a plaster screed on an interior end.

15. The straw bale wall vent box recited in claim 14 wherein said lower member further includes a trim piece substantially parallel said exterior side and extending upwardly towards said plaster screed.

16. The straw bale wall vent box recited in claim 15 wherein said first and second sides of said lower member are each bounded by said exterior side, said drainage floor, and said trim piece.

17. The straw bale wall vent box recited in claim 16 wherein said trim piece joins said plaster screed.

18. The straw bale wall vent box recited in claim 14 wherein a space defined by said first and second sides, said exterior side, and beneath said drainage floor, includes an insulation.

19. The straw bale vent box in claim 14 wherein said first and second sides of said lower member are each bounded by said exterior side and said drainage floor.

20. The straw bale vent box in claim 13 wherein said first and second sides of said lower member each include at least one aperture.

21. The straw bale wall vent box recited in claim 13 further including a slot and a tab.

22. A straw bale wall vent system, comprising:

a plurality of wall vent boxes wherein each said wall vent box includes a lower member including substantially parallel first and second sides, an exterior side, and a bottom side;

a substantially planar top member including a plurality of apertures and disposed above and substantially parallel to said bottom side, said top member including a stucco screed on an exterior end and a plaster screed on an interior end, said top member joining a top edge of said exterior side of said lower member; and a plurality of rebar disposed through said top member and said bottom side of said lower member;

wherein said plurality of wall vent boxes are placed side by side so that said first and second sides of adjacent said vent boxes are substantially in contact.

23. The straw bale wall vent system recited in claim 22 wherein said lower member of each said vent box further includes a drainage floor sloping downwardly from said exterior side, said rebar being disposed through said drainage floor.

24. The straw bale wall vent system recited in claim 22 wherein each said vent box includes a space defined by said bottom side, said drainage floor, said exterior side, and said first and second sides, said space including an insulation.

25. The straw bale wall vent system recited in claim 22 wherein said first and second sides of said lower member of each said vent box each include at least one aperture.

26. The straw bale wall vent system recited in claim 25 wherein each said vent box includes a trim piece substantially parallel said exterior side and extending upwardly from said bottom side to join said plaster screed, said system further including an air blower configured to force air into one of said vent boxes through an inlet, and an outlet through which air may escape from one of said vent boxes so that said air can circulate through said plurality of vent boxes.

27. The straw bale wall vent system recited in claim 25 wherein each said vent box includes a trim piece substantially parallel said exterior side and extending upwardly from said bottom side to join said plaster screed, said system further including a vacuum source configured to draw air out from one of said vent boxes through an outlet, and an inlet through which air may enter one of said vent boxes such that said air can be drawn through said plurality of vent boxes.

28. The straw bale wall vent system recited in claim 25 wherein said vacuum source is a fireplace.

* * * * *